US006289611B1

(12) United States Patent
Patterson et al.

(10) Patent No.: US 6,289,611 B1
(45) **Date of Patent: *Sep. 18, 2001**

(54) GOLF SHOE OUTSOLE WITH BIO-MECHANICALLY POSITIONED WEAR BARS

(75) Inventors: Chad Patterson, West Springfield; Joel A. Singer, Quincy, both of MA (US)

(73) Assignee: Spalding Sports Worldwide, Inc.

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/321,413

(22) Filed: May 28, 1999

(51) Int. Cl.[7] ..... A43B 5/00; A43B 23/28

(52) U.S. Cl. ..... 36/127; 36/59 C; 36/59 R; D2/906

(58) Field of Search ..... 36/59 C, 127, 36/59 R, 32 R, 114; D2/906, 954–969, 947–953

(56) References Cited

U.S. PATENT DOCUMENTS

| | | | | |
|---|---|---|---|---|
| D. 303,871 | * | 10/1989 | Driscoll | D2/320 |
| D. 376,683 | * | 12/1996 | Gaudio et al. | D2/897 |
| D. 387,891 | * | 12/1997 | Vestuti | D2/959 |
| D. 399,341 | * | 10/1998 | Munns | D2/951 |
| D. 400,346 | * | 11/1998 | Singer | D2/959 |
| D. 411,243 | * | 6/1999 | Lozano | D2/897 |
| D. 420,209 | * | 2/2000 | Singer | D2/951 |
| D. 420,496 | * | 2/2000 | Singer | D2/951 |
| D. 420,786 | * | 2/2000 | Ramer et al. | D2/952 |
| 3,492,744 | | 2/1970 | Bernier et al. | 36/59 |
| 3,559,308 | | 2/1971 | Bernier et al. | 36/2.5 |
| 5,943,794 | * | 8/1999 | Gelsomini | 36/127 |
| 6,016,613 | * | 1/2000 | Campbell et al. | 36/59 C |

* cited by examiner

*Primary Examiner*—Paul T. Sewell
*Assistant Examiner*—J. Mohandesi

(57) ABSTRACT

An outsole for a golf shoe includes a sole member having a plurality of pyramid-shaped protrusions and a plurality of spikes extend outwardly from the outer surface of the sole member to improve traction with the ground surface. The outsole also includes a plurality of longitudinally extending wear bars. Each of the wear bars extends outwardly from the outer surface of the sole member to a pair of ground engagement surfaces which are separated by a notch. The positions of the spikes and wear bars and the orientation of the wear bars are in part determined by bio-mechanical factors determined by the path of the center of pressure and the forces generated during the golfer's swing.

17 Claims, 6 Drawing Sheets

GOLF SHOE OUTSOLE WITH BIO-MECHANICALLY POSITIONED WEAR BARS

BACKGROUND OF THE INVENTION

The present invention relates to shoes, and more particularly to sports shoes having outer soles or outsoles having protrusions to provide increased traction.

Golf shoes are typically comprised of a shoe upper which is attached to some or all of an inner sole, a mid-sole and an outsole. For many years, golf shoes have employed nail-type spikes to increase the traction between the shoe and the grass of the golf course and thereby improve the golfer's footing. These spikes were threaded into sockets carried by a plate mounted on the hidden side of the outsole. Recently, a growing trend has developed away from the use of metal spikes to reduce the incidence of damage to the putting greens.

Initially, golf shoe manufacturers replaced the metal spikes with disc-like, softer spikes composed of a polymeric material, which do less damage to the putting greens. Such soft spikes often utilize the same threaded mounting as did traditional metal spikes, and can be directly substituted in the threaded sockets. New forms of sockets have been developed to accommodate further developments in such soft spikes to improve the traction provided by such spikes and to make it easier and quicker to replace the soft spikes. Some newer golf shoe designs have utilized outsoles having a plurality of integral, pyramid-shaped protrusions instead of spikes. The protrusions are also composed of polymeric material.

The soft spikes and protrusions have reduced the incidence of damage to the putting greens. However, the polymeric material of such soft spikes and protrusions is more susceptible to wear than the metal spikes and must therefore be replaced at more frequent intervals. In an attempt to lengthen the expected lifetime of the soft spikes and protrusions, golf shoe manufacturers have modified the design of the outsoles to include wear bars composed of polymeric material. Such wear bars generally have a rectangular shape and extend downwardly from the surface of the outsole to a support surface which has a much greater surface area than that of the spikes and protrusions. Positioning the wear bars on the outsole is critical to the design of the golf shoe since the wear bars have an adverse effect on traction.

SUMMARY OF THE INVENTION

Briefly stated, the invention in a preferred form is an outsole for a golf shoe which includes a sole member having an outer surface. A plurality of traction enhancing protrusions and a plurality of spikes extend outwardly from the outer surface of the sole member to a ground engagement tip and at least one ground gripping surface, respectively. The outsole also includes a plurality of longitudinally extending wear bars. Each of the wear bars extends outwardly from the outer surface of the sole member to a pair of ground engagement surfaces which are separated by a notch.

The positions of the spikes and wear bars and the orientation of the wear bars are in part determined by biomechanical factors determined by the path of the center of pressure and the forces generated during the golfer's swing. In a preferred embodiment, the outsole for a right shoe has three spikes and three wear bars disposed in the lateral area of the sole portion of the sole member, two spikes and four wear bars disposed in the medial area of the sole portion of the sole member, and a single spike and a single wear bar disposed in each of the lateral and medial areas of the heel portion of the sole member. The outsole for the left shoe has three spikes and three wear bars disposed in the lateral area of the sole portion of the sole member, two spikes and five wear bars disposed in the medial area of the sole portion of the sole member, and a single spike and a single wear bar disposed in each of the lateral and medial areas of the heel portion of the sole member. The spikes and the wear bars of the sole portion are longitudinally spaced.

Each of the wear bars has first and second sides and oppositely disposed ends. The first and second sides converge at the ends at an acute angle to define vertically extending end ridges. The notch defines a pair of oppositely disposed dimples in the first and second sides of the wear bar.

It is an object of the invention to provide a new and improved outsole for a golf shoe.

It is also an object of the invention to provide an outsole for a golf shoe having wear bars that provide improved traction with the ground and which reduce the rate of wear of other traction-enhancing elements of the outsole.

Other objects and advantages of the invention will become apparent from the drawings and specification.

Brief Description of the Drawings

The present invention may be better understood and its numerous objects and advantages will become apparent to those skilled in the art by reference to the accompanying drawings in which.

Description of the Preferred Embodiments

Figure 1:
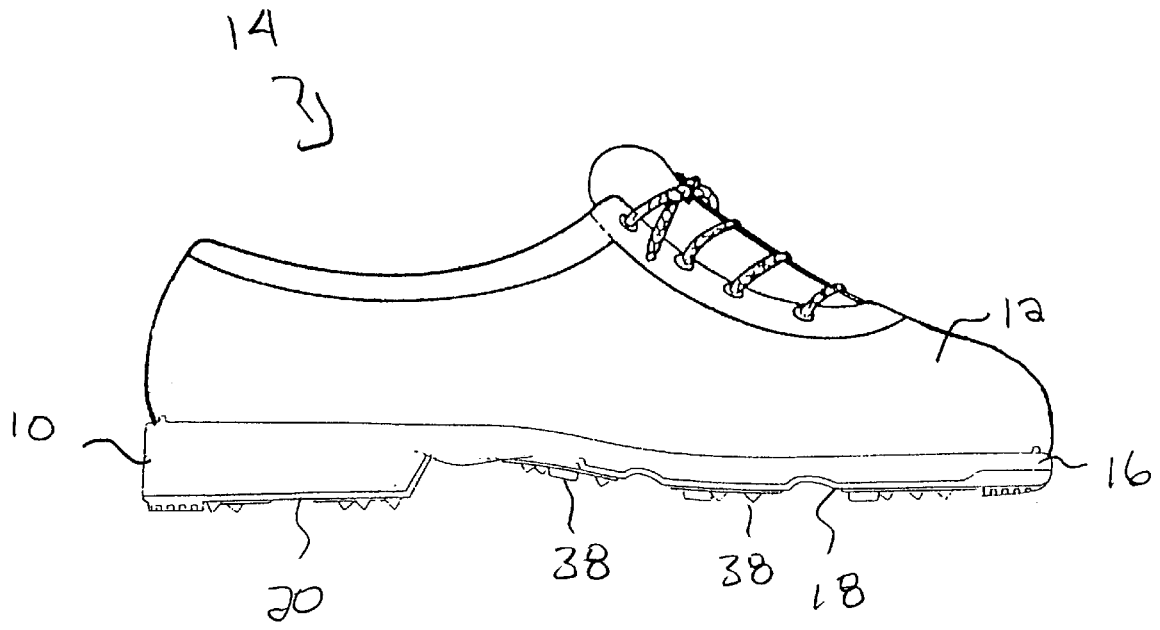
FIG. 1 is a side view of a golf shoe for a right foot, the golf shoe having an outsole in accordance with the present invention.

With reference to the drawings wherein like numerals represent like parts throughout the several figures, a golf shoe outsole in accordance with the present invention is generally designated by the numeral 10. As shown in FIG. 1, an outsole 10 in accordance with the present invention is mounted to an inner sole (not shown) and an upper 12 to form a golf shoe 14. The outsole 10 includes a sole member 16 defining the sole and heel portions 18, 20 of the shoe 14. The shoe upper 12 and the shoe inner sole are well known in the art and may be comprised of any material suitable for use while playing golf. The golf shoe 14 may also include a mid-sole (not shown).

Figure 7:
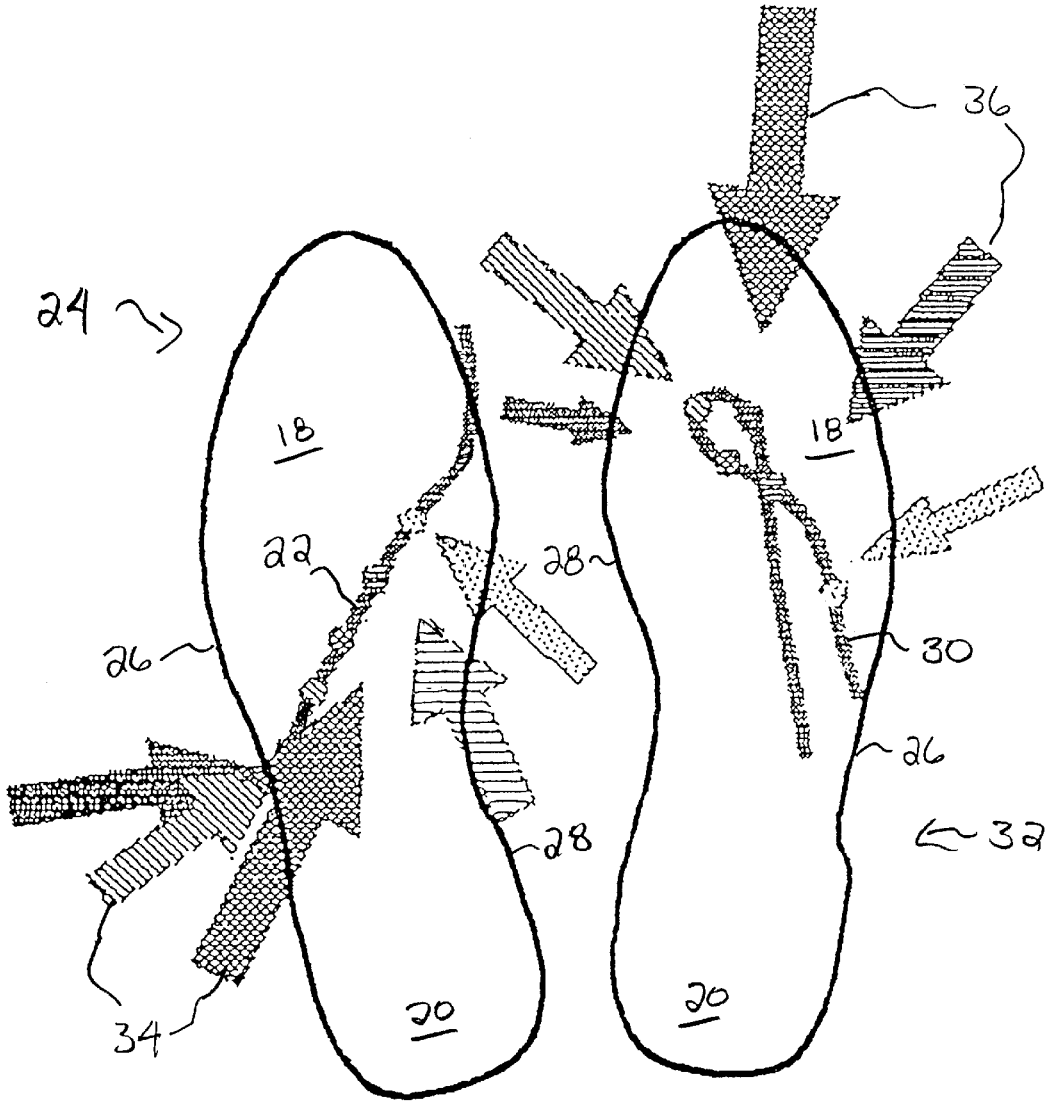
FIG. 7 is a schematic bottom view of a golfer's left and right shoes illustrating the path of the center of pressure and the direction and relative magnitude of the forces exerted during the golfer's downswing.
Figure 8:
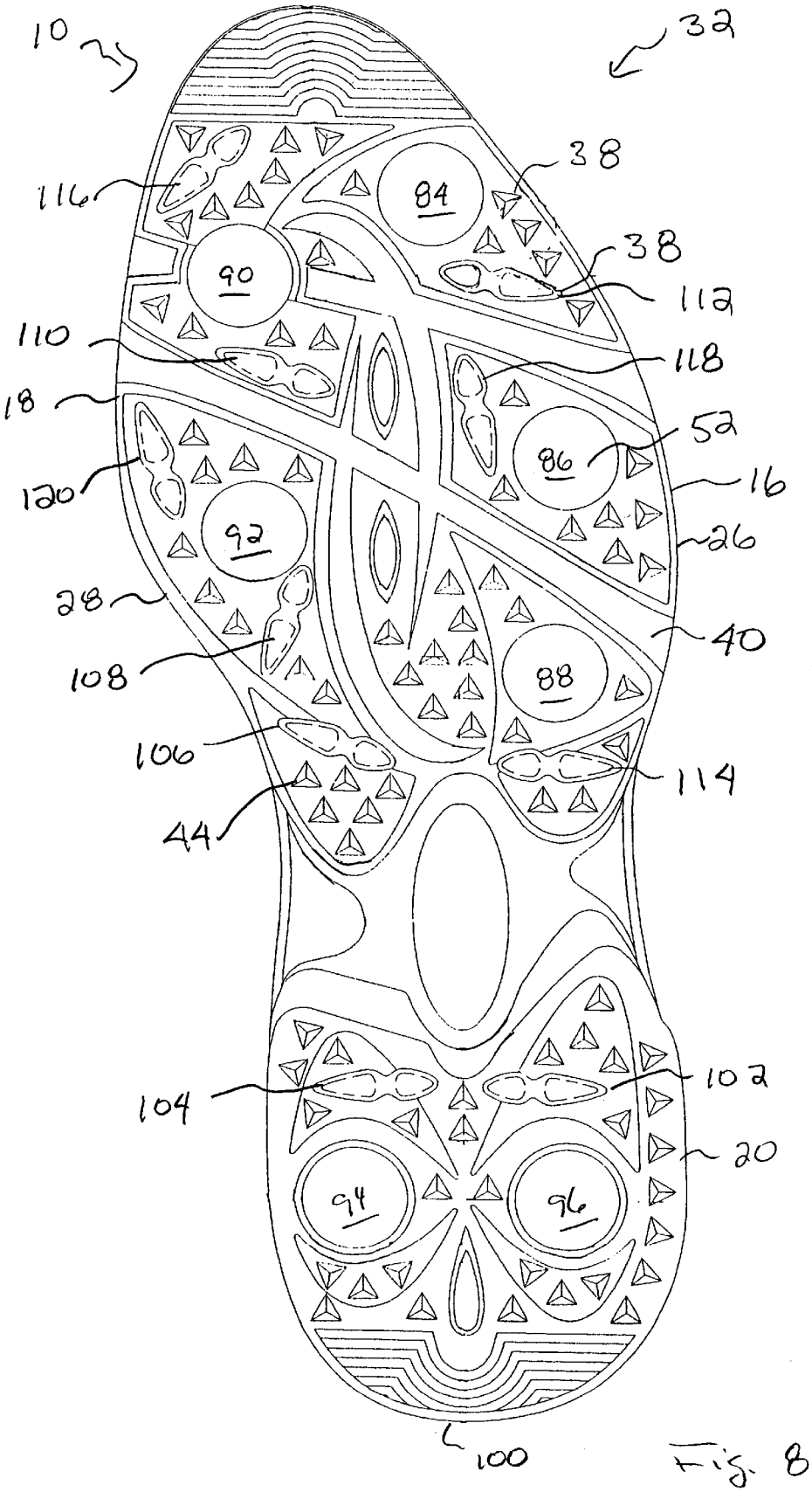
FIG. 8 is an enlarged bottom view of the shoe in accordance with the present invention for a left foot.

During the golfer's downswing, the center of pressure 22 for the right shoe 24 traverses the sole portion 18 of the shoe 24 from the lateral side 26 to the medial side 28 and the center of pressure 30 for the left shoe 32 moves in a rough figure-8 shaped pattern extending from the lateral side 26 to the middle of the sole portion 18, as illustrated in FIG. 7. Further, the right shoe 24 is subject to pressure which tends to move the shoe 24 forward and the left shoe 32 is subject to pressure which tends to move the shoe 32 rearward, as indicated the pressure vectors 34, 36 . Should either of the golfer's shoes 24, 32 slip during his downswing, it is almost certain that the resulting shot will be less than optimal. It should be appreciated that the probability of such slippage is increased when the golf course is damp or wet and when the golf ball is on an uphill or downhill lie.

To reduce the probability of slippage between the golf shoe 14 and the course surface, the outsole 10 further includes a variety of traction-enhancing elements 38 that extend downwardly from the outer surface 40 of the sole member 16. Such traction-enhancing elements 38 distinguish golf shoes 14 from regular street shoes. The traction-enhancing elements 38 include soft spikes 42, pyramid-shaped protrusions 44, and wear bars 46. All of the traction-enhancing elements 38 are composed of a material which is soft relative to traditional metal spikes, for example polymeric material, to prevent damage to the golf course putting greens. Although the pyramid-shape of the protrusions 44 provides superior traction, the relatively small area of the pyramid tip 48 causes the protrusion 44 to be particularly susceptible to wear. The ground engagement surfaces 50 of the wear bars 46 have a relatively large surface area which is substantially co-planar with the tips 48 of the surrounding protrusions 44 to reduce the rate of wear of the protrusions 44 and thereby extend the life of the golf shoe 14. In addition, the wear bars 46 help reduce the rate of wear of the soft spikes 42.

The outsole 10 includes a plurality of receptacles 52 for removably mounting the soft spikes 42 to the outsole 10. Such mounting means 54 are well known in the art. The receptacles 52 may be integrally formed with the sole member 16 or separately attached.

In one preferred embodiment of the invention, each of the receptacles 52 includes a lip 56 which extends outward from the outsole outer surface 40. The base 58 of the soft spike 42 is received within the lip 56 such that the lip 56 prevents dirt and moisture from entering the receptacle 52.

Figure 6:
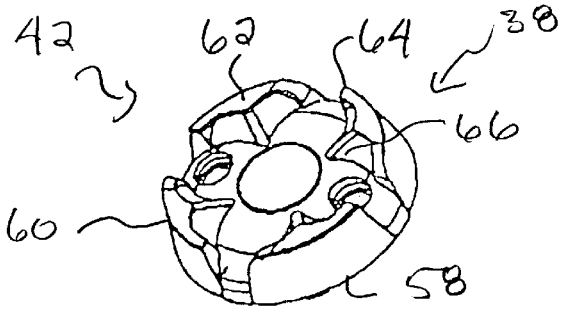
FIG. 6 is an enlarged perspective view of the soft spike.

Each of the soft spikes 42 has one or more outwardly extending engagement members 60 for contacting the golf course surface. In the embodiment shown in FIG. 6, four engagement members 60 are equidistantly spaced on the outer rim of the soft spike 42. The outer surface 62 of each engagement member 60 has a relatively large surface area to reduce the wear rate of the spike 42. Protrusions 64, 66 extend from the side edges and inner face of each engagement member 60. The relatively narrow shape of the protrusions 64, 66 facilitates engagement with the golf course surface to resist lateral movement of the spike 42 relative to the golf course surface.

Figure 2:
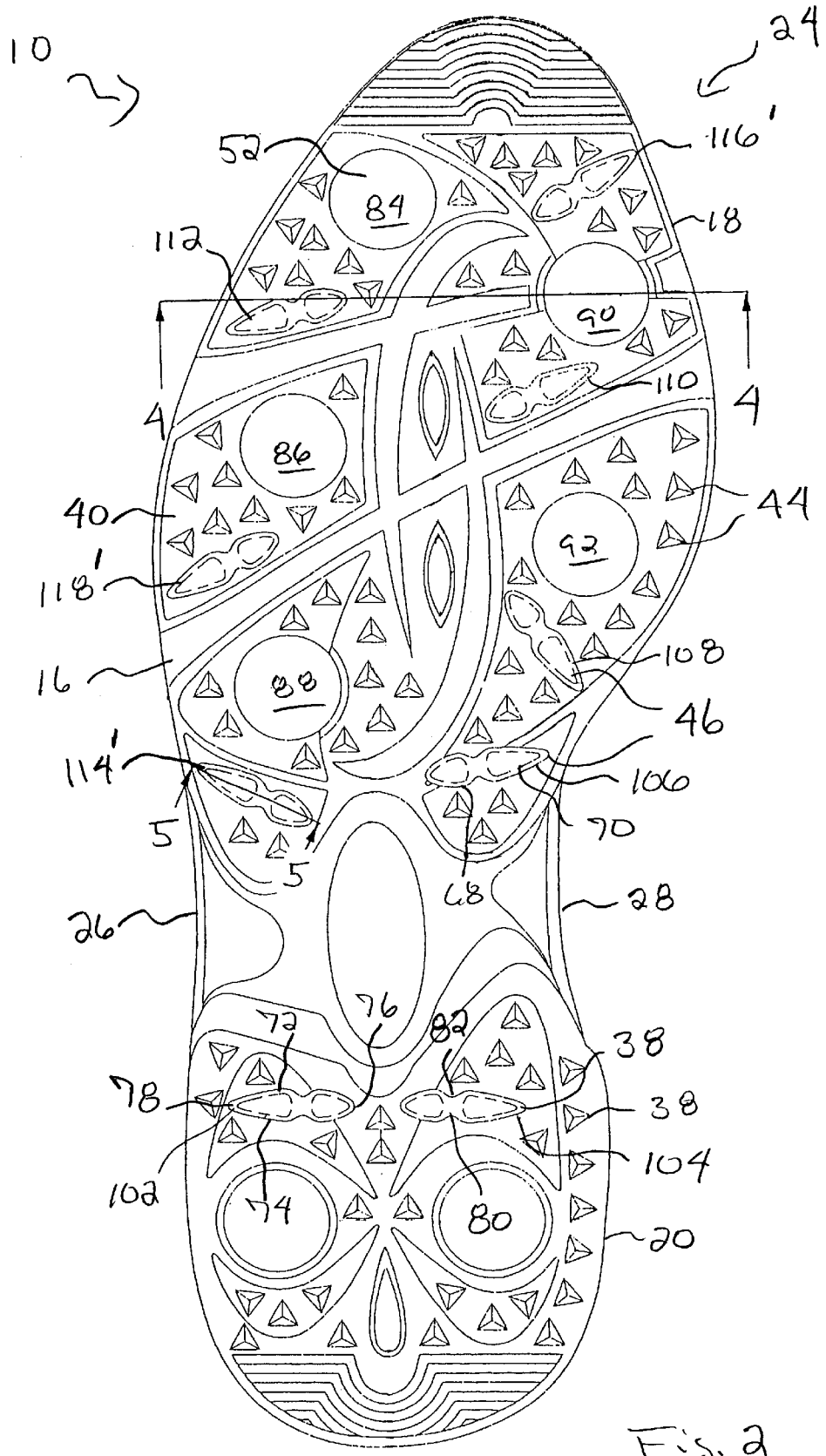
FIG. 2 is an enlarged bottom view of the shoes of FIG. 1.
Figure 3:
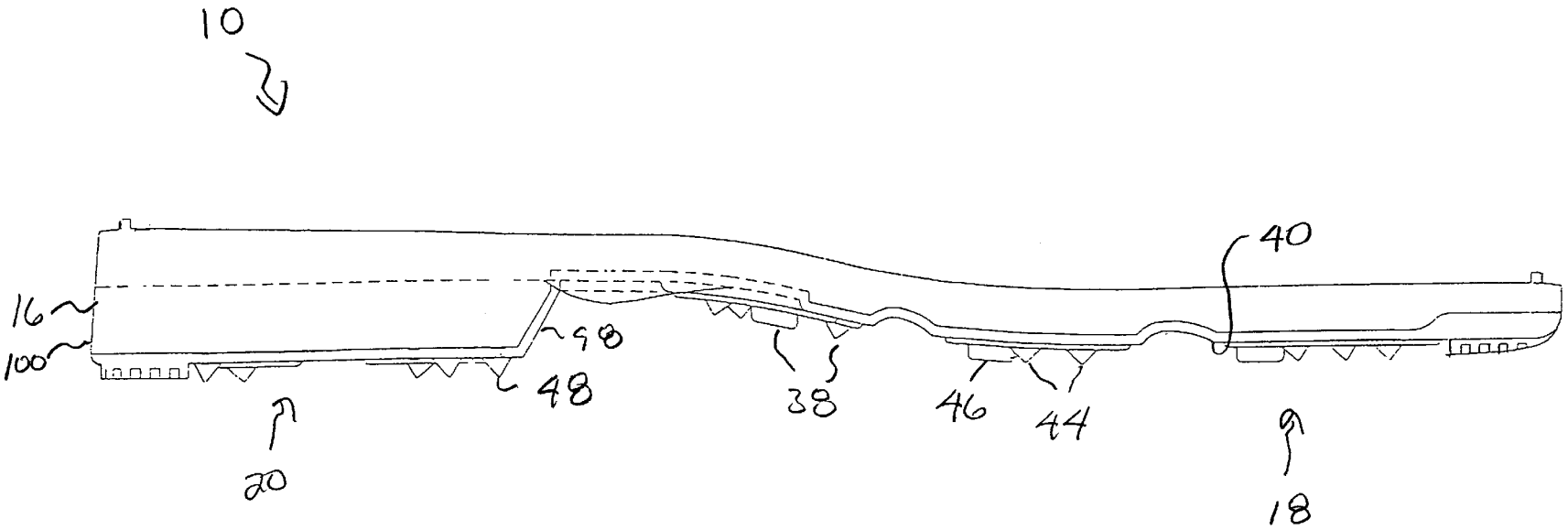
FIG. 3 is a side view, partly in phantom, of the outsole of FIG. 2 with the soft spikes removed.
Figure 4:
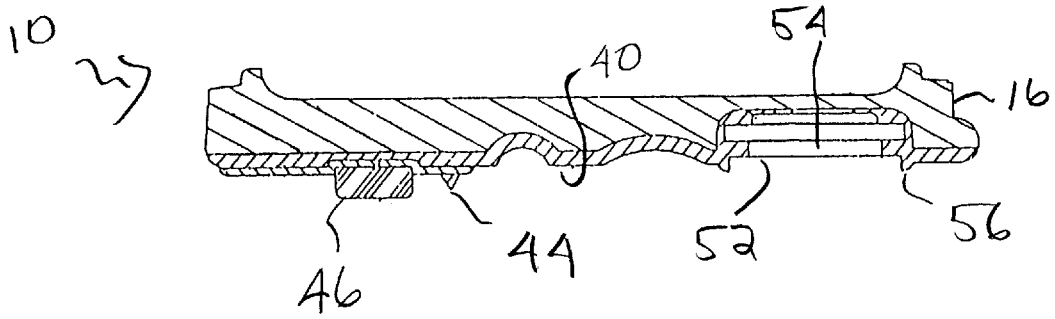
FIG. 4 is a cross-section view, taken along line 4—4, of the outsole of FIG. 2.
Figure 5:
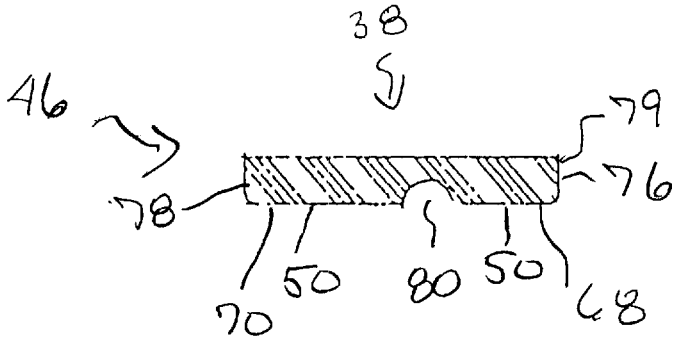
FIG. 5 is an enlarged cross-section view, taken along line 5—5, of the outsole of FIG. 2.

With reference to FIGS. 2 and 5, each of the wear bars 46 has oppositely disposed wedge-shaped end portions 68, 70. The sides 72, 74 of the wear bar 46 meet at an acute angle at the opposite ends 76, 78 of the wear bar 46, forming vertically extending end ridges 79. The end portions 68, 70 are separated by a notch 80 which extends from the outer surface 50 of the wear bar 46 to a height intermediate the outer surface 40 of the sole member 16 and the outer surface 50 of the wear bar 46. The notch 80 also forms a pair of oppositely disposed dimples 82 in the sides 72 of the wear bar 46 which extend inwardly toward the axis of the wear bar 46. The wedge-shape of the end portions 68, 70, the end ridges 79 and the notch 80 produce a wear bar 46 that provides better traction between the shoe 14 and the surface of the golf course. However, there is a trade-off for this increased traction. The notch 80 reduces the area of the engagement surface 50 and thereby partially mitigate the wear bar's ability reduce the wear rate of the protrusions 44 and soft spikes 42.

The positions of the receptacles 52 and wear bars 46 and the orientation of the wear bars 46 are determined by a combination of factors including, the outline or "footprint" of the sole and heel portions 18, 20 of the golf shoe 14 and bio-mechanical factors determined by the path of the center of pressure 22, 30 and the forces 34, 36 generated during the golfer's swing.

With reference to FIGS. 2 and 8, there are seven receptacles 52 positioned along the periphery of the outsole 10 of each shoe 24, 32. Although there are slight variations, the receptacles 52 of the outsole 10 of the left shoe 32 are positioned in substantially the same locations as the receptacles 52 of the outsole 10 of the right shoe 24. Five of the receptacles 52 are located in the sole portion 18 of the outsole 10 with three receptacles 84, 86, 88 being positioned along the lateral side 26 of the sole portion 18 and two receptacles 90, 92 being positioned along the medial side 28 of the sole portion 18. The sole portion receptacles 84, 86, 88, 90, 92 are longitudinally spaced and the positions of the medial side receptacles 90, 92 are staggered with respect to the positions of the lateral side receptacles 84, 86, 88 with the first medial side receptacle 90 being positioned intermediate the first and second lateral side receptacles 84, 86 and the second medial side receptacle 92 being positioned intermediate the second and third lateral side receptacles 86, 88. The remaining two receptacles 94, 96 are positioned on the medial and lateral sides 28, 26 of the heel portion 20 substantially midway between the front and rear ends 98, 100 of the heel portion 20.

The outsole 10 of the right shoe 24 has nine wear bars 46 and the outsole 10 of the left shoe 32 has ten wear bars 46. Eight of the wear bars 102, 104, 106, 108, 110, 112, 114, 116 on each shoe 24, 32 are positioned at substantially identical locations. The orientation of six of these wear bars 102, 104, 106, 108, 110, 112 are substantially identical while the seventh wear bar 114 of the outsole 10 of the left shoe 32 is rotated approximately 5° counter-clockwise relative to the seventh wear bar 114 of the outsole 10 at the right shoe 24 and the eighth wear bar 116 of the outsole 10 of the left shoe 32 is rotated approximately 80° clockwise relative to the eighth wear bar 116 of the outsole 10 of the right shoe 24. The ninth wear bar 118 of the outsole 10 of the right shoe 24 is positioned laterally and to the rear of the second lateral receptacle 86 and has a substantially medial-to-lateral orientation. The ninth wear bar 118 of the outsole 10 of the left shoe 32 is positioned medially and to the front of the second lateral receptacle 86 and has a substantially front-to-rear orientation. The tenth wear bar 120 of the outsole 10 of the left shoe 32 is positioned medially and to the front of the second medial receptacle 92 and has a substantially front-to-rear orientation.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. An outsole for a right or left golf shoe comprising:

a sole member having an outer surface;

a plurality of pyramid-shaped protrusions extending outwardly from the outer surface of the sole member to a ground engagement tip;

a plurality of receptacles disposed within the sole member;

a plurality of spikes, each of the spikes having a mounting portion removably mounted within one of the receptacles and at least one engagement portion extending outwardly from the outer surface; and a plurality of longitudinally extending wear bars, each of the wear bars extending outwardly from the outer surface of the sole member and having oppositely disposed first and second ends, first and second sides, first and second end portions, a mid portion disposed between the first and second end portions, and no part in common with another wear bar, the first and second end portions each extending outwardly from the outer surface of the sole member to a ground engagement surface, the first and second sides converging at the first and second ends at an acute angle, the first and second ends each extending substantially perpendicular from the outer surface of the sole member, the mid portion extending outwardly from the outer surface of the sole member to a base surface disposed intermediate the outer surface of the sole member and the ground engagement surfaces of the first and second end portions, the base surface extending from the first side of the wear bar to the second side of the wear bar wherein the mid portion defines a notch completely separating the first end portion from the second end portion.

2. The outsole of claim 1 wherein the notch defines a pair of oppositely disposed dimples in the first and second sides of the wear bar.

3. The outsole of claim 1 wherein the sole member of the outsole has a sole portion, a heel portion, a front and a rear, the sole and heel portions each having lateral and medial areas, the receptacles being positioned in the lateral and medial areas of the sole and heel portions.

4. The outsole of claim 3 wherein three receptacles are disposed in the lateral area of the sole portion, two receptacles are disposed in the medial area of the sole portion, and a single receptacle is disposed in each of the lateral and medial areas of the heel portion.

5. The outsole of claim 4 wherein the receptacles of the sole portion are longitudinally spaced with a second lateral side receptacle being disposed intermediate a front first lateral side receptacle and a rear third lateral side receptacle, a front medial side receptacle being positioned intermediate the first and second lateral side receptacles and a rear medial side receptacle being positioned intermediate the second and third lateral side receptacles.

6. The outsole of claim 4 wherein the receptacles of the heel portion are positioned intermediate a front end of the heel portion and a rear end of the heel portion.

7. The outsole of claim 1 wherein the sole member of the outsole has a sole portion, a heel portion, a front and a rear, the sole and heel portions each having lateral and medial areas, the wear bars being positioned in the lateral and medial areas of the sole and heel portions.

8. The outsole of claim 7 wherein an outsole for a right shoe has a single group of three wear bars disposed in the lateral area of the sole portion, a single group of four wear bars disposed in the medial area of the sole portion, and a single wear bar disposed in each of the lateral and medial areas of the heel portion and an outsole for a left shoe has a single group of three wear bars disposed in the lateral area of the sole portion, a single group of five wear bars disposed in the medial area of the sole portion, and a single wear bar disposed in each of the lateral and medial areas of the heel portion.

9. The outsole of claim 8 wherein the wear bars of the sole portion are longitudinally spaced.

10. The outsole of claim 8 wherein the wear bars of the heel portion are positioned proximate a front end of the heel portion.

11. An outsole for a right or left golf shoe comprising:

a sole member having an outer surface;

a plurality of pyramid-shaped protrusions extending outwardly from the outer surface of the sole member to a ground engagement tip;

a plurality of spikes extending outwardly from the outer surface of the sole member to at least one ground gripping surface; and a plurality of longitudinally extending wear bars, each of the wear bars having no part in common with another wear bar, each of the wear bars having oppositely disposed first and second ends, oppositely disposed first and second end portions, first and second sides, and a notch disposed intermediate the first and second end portions, the first and second sides converging at the first and second ends at an acute angle, the first and second ends each extending substantially perpendicular from the outer surface of the sole member, the notch extending from the first side of the wear bar to the second side of the wear bar, each of the wear bars extending outwardly from the outer surface of the sole member to a pair of ground engagement surfaces completely separated by the notch.

12. The outsole of claim 11 wherein the sole member of the outsole has a sole portion, a heel portion, a front and a rear, the sole and heel portions each having lateral and medial areas, the spikes and wear bars being positioned in the lateral and medial areas of the sole and heel portions.

13. The outsole of claim 12 wherein a plurality of spikes and a plurality of wear bars are disposed in the lateral area of the sole portion, a plurality of spikes and a plurality of wear bars are disposed in the medial area of the sole portion, and at least one spike and at least one wear bar is disposed in each of the lateral and medial areas of the heel portion.

14. The outsole of claim 13 wherein the spikes and the wear bars of the sole portion are longitudinally spaced.

15. The outsole of claim 12 wherein an outsole for a right shoe has three spikes and a single group of three wear bars disposed in the lateral area of the sole portion, two spikes and a single group of four wear bars disposed in the medial area of the sole portion, and a single spike and a single wear bar disposed in each of the lateral and medial areas of the heel portion and an outsole for a left shoe has three spikes and a single group of three wear bars disposed in the lateral area of the sole portion, two spikes and a single group of five wear bars disposed in the medial area of the sole portion, and a single spike and a single wear bar disposed in each of the lateral and medial areas of the heel portion.

16. The outsole of claim 15 wherein the spikes and the wear bars of the sole portion are longitudinally spaced.

17. An outsole for a right or left golf shoe comprising:

a sole member having an outer surface;

a plurality of traction enhancing protrusions extending outwardly from the outer surface of the sole member;

a plurality of spikes extending outwardly from the outer surface of the sole member to at least one ground gripping surface; and a plurality of longitudinally extending wear bars, each of the wear bars having oppositely disposed first and second ends, oppositely disposed first and second end portions, first and second sides, and a notch disposed intermediate the first and second end portions, the first and second sides converging at the first and second ends at an acute angle, the first and second ends each extending substantially perpendicular from the outer surface of the sole member, the notch extending from the first side to the second side, each of the wear bars having no part in common with another wear bar and extending outwardly from the outer surface of the sole member to a pair of ground engagement surfaces completely separated by the notch.

* * * * *